US009435342B2

(12) United States Patent
Kiem et al.

(10) Patent No.: US 9,435,342 B2
(45) Date of Patent: Sep. 6, 2016

(54) HORIZONTAL TYPE SCROLL COMPRESSOR

(71) Applicant: LG ELECTRONICS INC., Seoul (KR)

(72) Inventors: Myungkyun Kiem, Seoul (KR); Kijung An, Seoul (KR); Ikseo Park, Seoul (KR); Taesoon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

(21) Appl. No.: 14/383,393

(22) PCT Filed: Mar. 7, 2013

(86) PCT No.: PCT/KR2013/001828

§ 371 (c)(1),
(2) Date: Sep. 5, 2014

(87) PCT Pub. No.: WO2013/133635

PCT Pub. Date: Sep. 12, 2013

(65) Prior Publication Data

US 2015/0086404 A1 Mar. 26, 2015

(30) Foreign Application Priority Data

Mar. 7, 2012 (KR) ..... 10-2012-0023532

(51) Int. Cl.
*F01C 1/02* (2006.01)
*F04C 18/07* (2006.01)
(Continued)

(52) U.S. Cl.
CPC ..... *F04C 18/07* (2013.01); *F04C 18/0215* (2013.01); *F04C 23/008* (2013.01); *F04C 29/0042* (2013.01); *F04C 29/0057* (2013.01); *F04C 2240/52* (2013.01)

(58) Field of Classification Search
CPC F04C 23/008; F04C 2230/60; F04C 29/126; F04C 2/06; F01C 1/0215; F01C 1/22; F01C 18/22; F01C 17/06; F01C 17/02; F02B 53/00; G01F 3/08; F01F 3/12
USPC ..... 415/55.1, 54, 58
See application file for complete search history.

(56) References Cited

U.S. PATENT DOCUMENTS 5,152,682 A * 10/1992 Morozumi ..... F04C 23/008 418/151
5,336,068 A 8/1994 Sekiya et al. ..... 418/55.2
(Continued)

FOREIGN PATENT DOCUMENTS

CN 1436935 8/2003
CN 1601086 3/2005
(Continued)

OTHER PUBLICATIONS

International Search Report and Written Opinion dated May 29, 2013 issued in Application No. PCT/KR2013/001828.
(Continued)

*Primary Examiner* — Patrick Maines
(74) *Attorney, Agent, or Firm* — Ked & Associates LLP

(57) ABSTRACT

A horizontal type scroll compressor includes a motor housing with a driving motor therein, a main scroll coupled to one side of the motor housing and having a fixed wrap for forming compression chambers, an orbiting scroll having an orbiting wrap and coupled to a crankshaft inserted through the main scroll, the orbiting scroll forming a first compression chamber and a second compression chamber on an outer surface and an inner surface of the orbiting wrap while performing an orbiting motion, and a front housing hermetically coupled to the main scroll. With the configuration, the number of components and assembly parts may be reduced, resulting in reduction of fabricating costs. Also, an inclination of the orbiting scroll can be prevented as the crankshaft is inserted through the fixed wrap and the orbiting wrap.

15 Claims, 8 Drawing Sheets

(51) Int. Cl.

| | |
|---|---|
| ***F04C 23/00*** | (2006.01) |
| ***F04C 29/00*** | (2006.01) |
| ***F04C 18/02*** | (2006.01) |

(56) References Cited

U.S. PATENT DOCUMENTS

| | | | | |
|---|---|---|---|---|
| 6,030,192 | A * | 2/2000 | Hill | F04C 18/0215 418/55.2 |
| 6,887,051 | B2 | 5/2005 | Sakuda et al. | 418/55.2 |
| 7,371,059 | B2 | 5/2008 | Ignatiev et al. | 428/151 |
| 2003/0147763 | A1* | 8/2003 | Sakuda | F04C 18/0215 418/55.1 |
| 2007/0217934 | A1* | 9/2007 | Tateishi | F04C 18/0215 418/55.1 |
| 2008/0069713 | A1* | 3/2008 | Ignatiev | F04C 18/0215 418/55.3 |
| 2010/0129240 | A1* | 5/2010 | Shiibayashi | F04C 18/0215 417/410.5 |
| 2011/0129378 | A1* | 6/2011 | Hasegawa | F04C 18/0215 418/55.1 |
| 2012/0230855 | A1* | 9/2012 | Seong | F04C 18/0215 418/55.2 |
| 2013/0004354 | A1* | 1/2013 | Kiem | F04C 18/0215 418/55.2 |
| 2013/0071278 | A1* | 3/2013 | Lee | F04C 18/0269 418/55.2 |
| 2013/0089449 | A1* | 4/2013 | Seong | F04C 23/001 418/55.2 |

FOREIGN PATENT DOCUMENTS

| | | | |
|---|---|---|---|
| CN | 101144474 | | 3/2008 |
| CN | 102062098 | | 5/2011 |
| CN | 102094826 | | 6/2011 |
| JP | 2-277985 | | 11/1990 |
| JP | 03294683 | A * | 12/1991 |
| JP | 08-0326671 | | 12/1996 |
| JP | 2000-249086 | A | 9/2000 |
| JP | 2004-211595 | | 7/2004 |
| JP | 2004211595 | A * | 7/2004 |
| JP | 2008-095588 | A | 4/2008 |

OTHER PUBLICATIONS

Chinese Office Action dated Dec. 11, 2015. (English Translation).

* cited by examiner

HORIZONTAL TYPE SCROLL COMPRESSOR

CROSS-REFERENCE TO RELATED PATENT APPLICATIONS

This application is a U.S National Stage Application under 35 U.S.C. §371 of PCT Application No. PCT/KR2013/001828, filed Mar. 7, 2013, which claims priority to Korean Patent Application No. 10-2012-0023532, filed Mar. 7, 2012, whose entire disclosures are hereby incorporated by reference.

TECHNICAL FIELD

The present disclosure relates to a horizontal type scroll compressor capable of being applied to vehicles.

BACKGROUND ART

In general, compressors are devices for compressing fluid such as refrigerant gas and the like, and may be classified into a rotary compressor, a reciprocal compressor, a scroll compressor and the like according to a method of compressing the fluid.

The scroll compressor is a high-efficiency and low-noise compressor which is widely applied to an air-conditioning field. The scroll compressor operates in the following manner. That is, while two scrolls respectively having a fixed wrap and an orbiting wrap orbit relatively, a plurality of compression chambers are formed as a pair between the fixed wrap and the orbiting wrap of each scroll. As their volumes of the compression chambers decrease while they continuously move toward their center, a refrigerant is continuously sucked, compressed and discharged.

Behaviors of the scroll compressor may depend on shapes of the fixed wrap and the orbiting wrap. Although they can have a random shape, the fixed wrap and the orbiting wrap typically have a shape of an involute curve which is easy to be processed. The involute curve refers to a curve corresponding to a track drawn by an end of a string, which is wrapped around a base circle having a random radius, when the string is unwound. Upon the use of the involute curve, wraps have a uniform thickness and accordingly a coefficient of volume change is constant. Therefore, in order to obtain a satisfactory compression ratio, the number of turns of the wrap has to increase. However, it also causes the compressor to increase in size.

FIG. 1 is a sectional view showing a structure of a horizontal type scroll compressor according to the related art.

As shown in FIG. 1, a scroll compressor according to the related art includes a main frame 2 and a sub frame 3 disposed within an inner space 11 of a casing 1 in a horizontal direction with a predetermined interval, a driving motor 4 installed between the main frame 2 and the sub frame 3 to generate a rotational force, and a crankshaft 5 formed in a center of a rotor 42 of the driving motor 4 and penetrating through the main frame 2 to be coupled to the orbiting scroll 7 so as to transfer the rotational force of the driving motor 4 thereto.

A fixed scroll 6 is fixed to a front of the main frame 2, and an orbiting scroll 7 is engaged with the fixed scroll 6 to form two compression chambers S as a pair which move continuously. An Oldham's ring 8 is installed between the orbiting scroll 7 and the main frame 2 such that the orbiting scroll 7 can orbit without rotation.

A shaft receiving hole 21 for supporting the crankshaft 5 in a radial direction is formed in the central portion of the main frame 2, and a main bearing 22 for supporting the crankshaft 5 in a radial direction is installed in the shaft receiving hole 21.

A fixed wrap 62 forming the pair of compression chambers S is formed in an involute shape on a rear surface of a fixed disk 61 of the fixed scroll 6. A suction port (not shown) is formed at a side surface of the fixed disk 61 to be directly connected to a suction pipe 13 such that a refrigerant can be sucked into the compression chambers S. A discharge port 63 is formed at a center of a front surface of the fixed disk 61 such that a refrigerant gas compressed in the compression chambers S can be discharged into the inner space 11 of the casing 1. A discharge valve 9 for opening or closing the discharge port 63 to prevent the refrigerant gas from flowing backwardly is disposed at a front surface of the fixed scroll 6.

An orbiting wrap 72 which forms two compression chambers S as a pair together with the fixed wrap 62 of the fixed scroll 6 is formed in an involute shape on a front surface of an orbiting disk 71 of the orbiting scroll 7. A boss portion 73 is formed at a center of a rear surface of the orbiting disk 61. The boss portion 73 is coupled to the crankshaft 5 to transfer the rotational force from the driving motor 4 to the crankshaft 5. A pin bearing 74 for support between the crankshaft 5 and the boss portion 73 in a radial direction is installed on an inner circumferential surface of the boss portion 73.

An unexplained reference numeral 12 denotes an inlet, 13 denotes an outlet, 31 denotes a sub bearing for supporting the crankshaft 4 in a radial direction, 41 denotes a stator of the driving motor 4, and 51 denotes an oil passage.

Hereinafter, description will be given of an operation of the related art scroll compressor.

That is, when power is applied to the driving motor 4, the crankshaft 5 rotates together with a rotor 42 of the driving motor 4. Accordingly, the orbiting scroll 7 orbits on an upper surface of the main frame 2 by the Oldham's ring 8 as far as an eccentric distance, and simultaneously, two, namely, a pair of compression chambers S are continuously formed between the fixed wrap 62 and the orbiting wrap 72. As the compression chambers move, with their volumes decreased, toward their center in response to a continuous orbiting motion of the orbiting scroll 7, a refrigerant gas is continuously, sucked, compressed and discharged.

DISCLOSURE OF INVENTION

Technical Problem

However, in the related art horizontal type scroll compressor, the main frame 2 and the fixed scroll 6 are separately installed within the casing 1, which causes an increase in the number of components. Also, the main frame 2 and the fixed scroll 6 have to be assembled to the casing 1, respectively, which increases the number of assembly parts, resulting in an increase in fabricating costs of the compressor.

Further, as the crankshaft 5 is coupled to the rear surface of the orbiting scroll 7, an application point to which a repulsive force of a refrigerant is applied is spaced apart in a vertical direction from an application point to which a reaction force for offsetting the repulsive force is applied during compression. Accordingly, the orbiting scroll 7 is inclined during operation, increasing vibration or noise. Especially, for the horizontal type scroll compressor, the orbiting scroll 7 is further inclined by its own weight, which may be likely to further increase the vibration or noise of the compressor.

Solution to Problem

Therefore, to obviate those problems, an aspect of the detailed description is to provide a horizontal type scroll compressor, capable of reducing fabricating costs by reduction of the number of components and the number of assembly parts.

Another aspect of the detailed description is to provide a horizontal type scroll compressor, capable of overcoming a problem of an inclination of an orbiting scroll, in a manner of controlling an application point of a repulsive force of a refrigerant and an application point of the corresponding reaction force to be applied onto the same portion.

To achieve these and other advantages and in accordance with the purpose of the present invention, as embodied and broadly described herein, there is provided a horizontal type scroll compressor including a motor housing having an inner space for installation of a driving motor therein, a main scroll coupled to one side of the motor housing to seal the inner space of the motor housing, and having a fixed wrap for forming compression chambers, an orbiting scroll having an orbiting wrap engaged with the fixed wrap of the main scroll and coupled to a crankshaft inserted through the main scroll, the orbiting scroll forming a first compression chamber and a second compression chamber on an outer surface and an inner surface of the orbiting wrap while performing an orbiting motion, and a front housing hermetically coupled to the main scroll, the front housing accommodating the orbiting scroll.

In accordance with another exemplary embodiment of the detailed description, there is provided a horizontal type scroll compressor including a casing, a driving motor installed within an inner space of the casing and having a rotor, a crankshaft coupled to the rotor, a main scroll coupled to the casing, the main scroll having a fixed wrap, and an orbiting scroll having an orbiting wrap engaged with the fixed wrap of the main scroll and coupled to a crankshaft inserted through the main scroll, the orbiting scroll forming a first compression chamber and a second compression chamber on an outer surface and an inner surface of the orbiting wrap while performing an orbiting motion, wherein a shaft coupling portion to which the crankshaft is inserted may be formed through the orbiting scroll.

Here, a plurality of pin members may be disposed on one of a rear surface of the orbiting scroll and the casing, and a plurality of pin recesses may be formed on the other one. The plurality of pin members may be inserted into the plurality of pin recesses to allow for orbiting of the orbiting scroll.

A ring member may be disposed between the rear surface of the orbiting scroll and the casing, the ring member preventing rotation of the orbiting scroll. An inner circumferential sliding surface and an outer circumferential sliding surface may be perpendicularly formed on an inner circumferential surface and an outer circumferential surface of the ring member, respectively. The sliding surfaces may slidably contact guide surfaces, respectively, in a radial direction. The guide surfaces may be disposed on the casing and the orbiting scroll, respectively.

The first compression chamber may be formed between two contact points P1 and P2 generated as an inner surface of the fixed wrap and an outer surface of the orbiting wrap contact each other. The crankshaft may include an eccentric pin coupled to a shaft coupling portion of the orbiting scroll. Here, $\alpha$ may be 360 ($\alpha<360°$ at least before the beginning of discharging when it is assumed that $\alpha$ is a larger angle of angles formed by two lines connecting a center O of the eccentric pin of the crankshaft and the two contact points P1 and P2, respectively.

Advantageous Effects of Invention

In accordance with the detailed description, in the horizontal type scroll compressor, the main scroll forming the fixed scroll may be located between the motor housing and the front housing to be fixed to both of them. This may allow the fixed scroll to be installed without a separate frame, resulting in reduction of the number of components. In addition, the number of assembly parts may be reduced by coupling the motor housing, the main scroll and the front housing all together by use of long coupling bolts, reducing fabricating costs accordingly.

Also, the crankshaft may be inserted through the fixed wrap of the main scroll and the orbiting wrap of the orbiting scroll. This may allow an application point of a repulsive force of a refrigerant and an application point of a corresponding reaction point to be applied to the same portion, thereby preventing the orbiting scroll from being inclined. With forming the protrusion and the concave portion at the discharge side of the fixed wrap and the orbiting wrap, a compression ratio of a first compression chamber may be improved and a thickness of an inner end portion of the fixed wrap may increase. This may result in improvement of a wrap strength and a leakage-preventing function.

BEST MODE FOR CARRYING OUT THE INVENTION

Embodiments of the present invention will be described below in detail with reference to the accompanying drawings where those components are rendered the same reference number that are the same or are in correspondence, regardless of the figure number, and redundant explanations are omitted. In describing the present invention, if a detailed explanation for a related known function or construction is considered to unnecessarily divert the gist of the present invention, such explanation has been omitted but would be understood by those skilled in the art. The accompanying drawings are used to help easily understood the technical idea of the present invention and it should be understood that the idea of the present invention is not limited by the accompanying drawings. The idea of the present invention should be construed to extend to any alterations, equivalents and substitutes besides the accompanying drawings.

Figure 1:
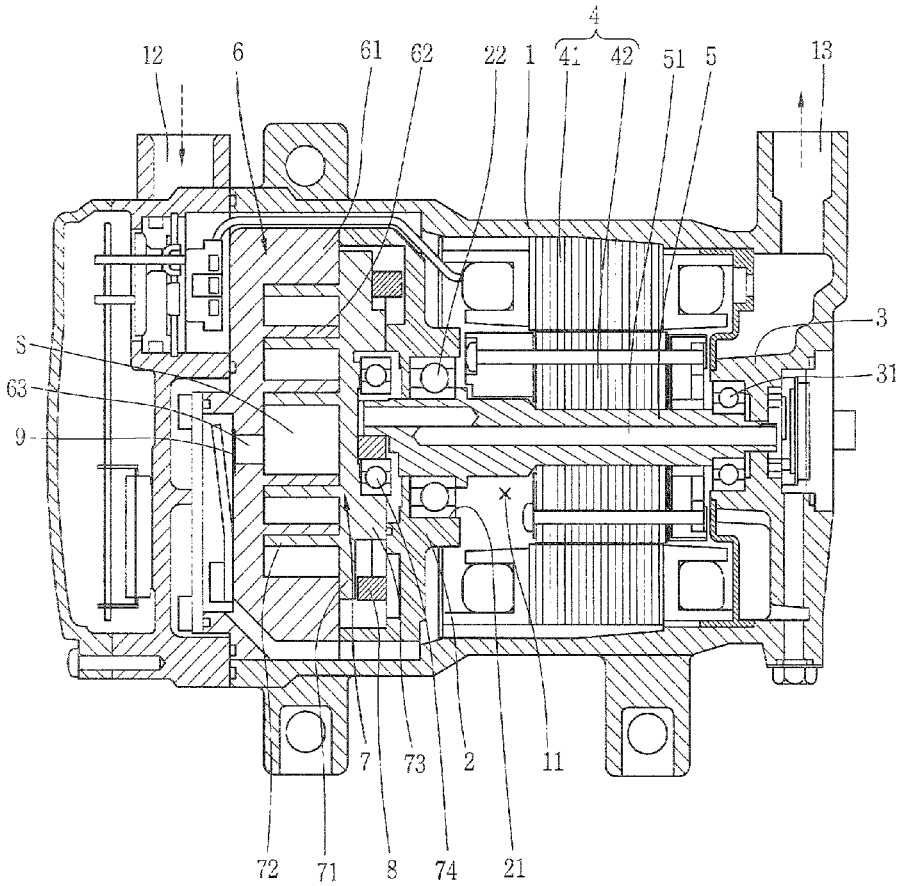
FIG. 1 is a longitudinal sectional view showing one exemplary embodiment of a scroll compressor according to the related art.
Figure 2:
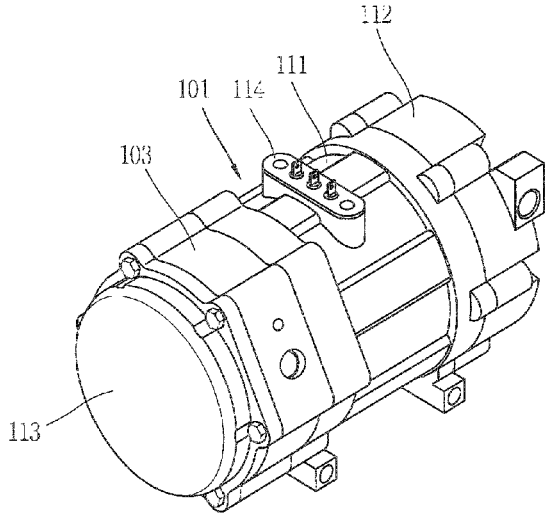
FIG. 2 is a perspective view showing one exemplary embodiment of a horizontal type scroll compressor in accordance with the present disclosure.
Figure 3:
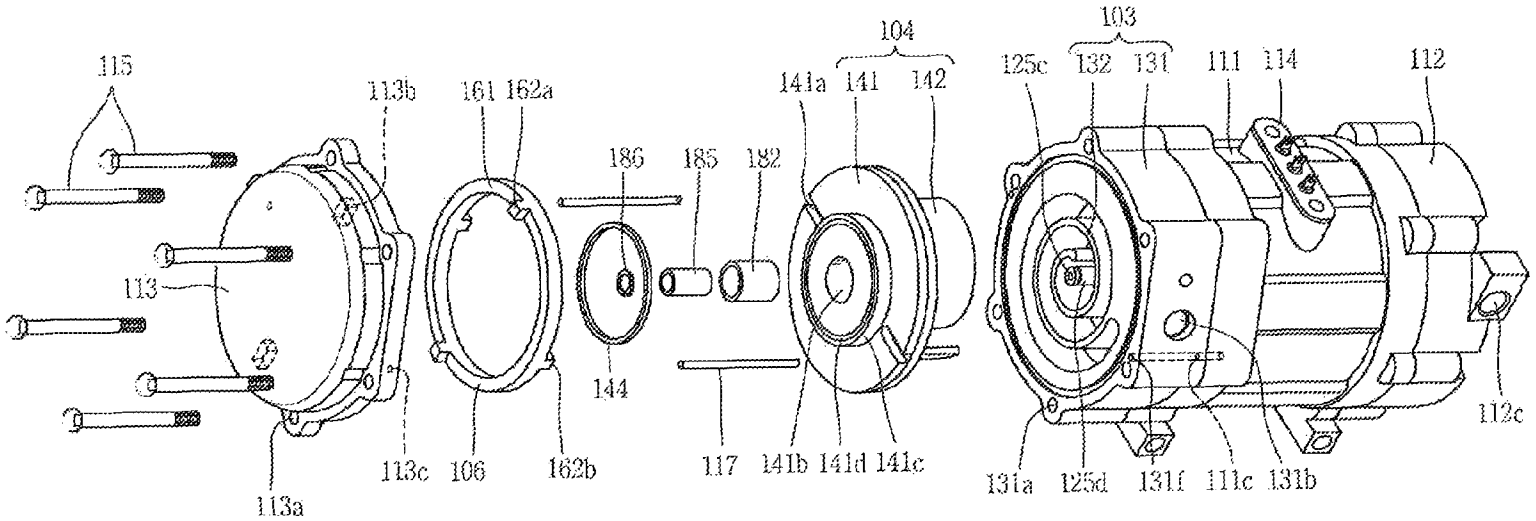
FIG. 3 is a disassembled perspective view of the horizontal type scroll compressor of FIG. 2.
Figure 4:
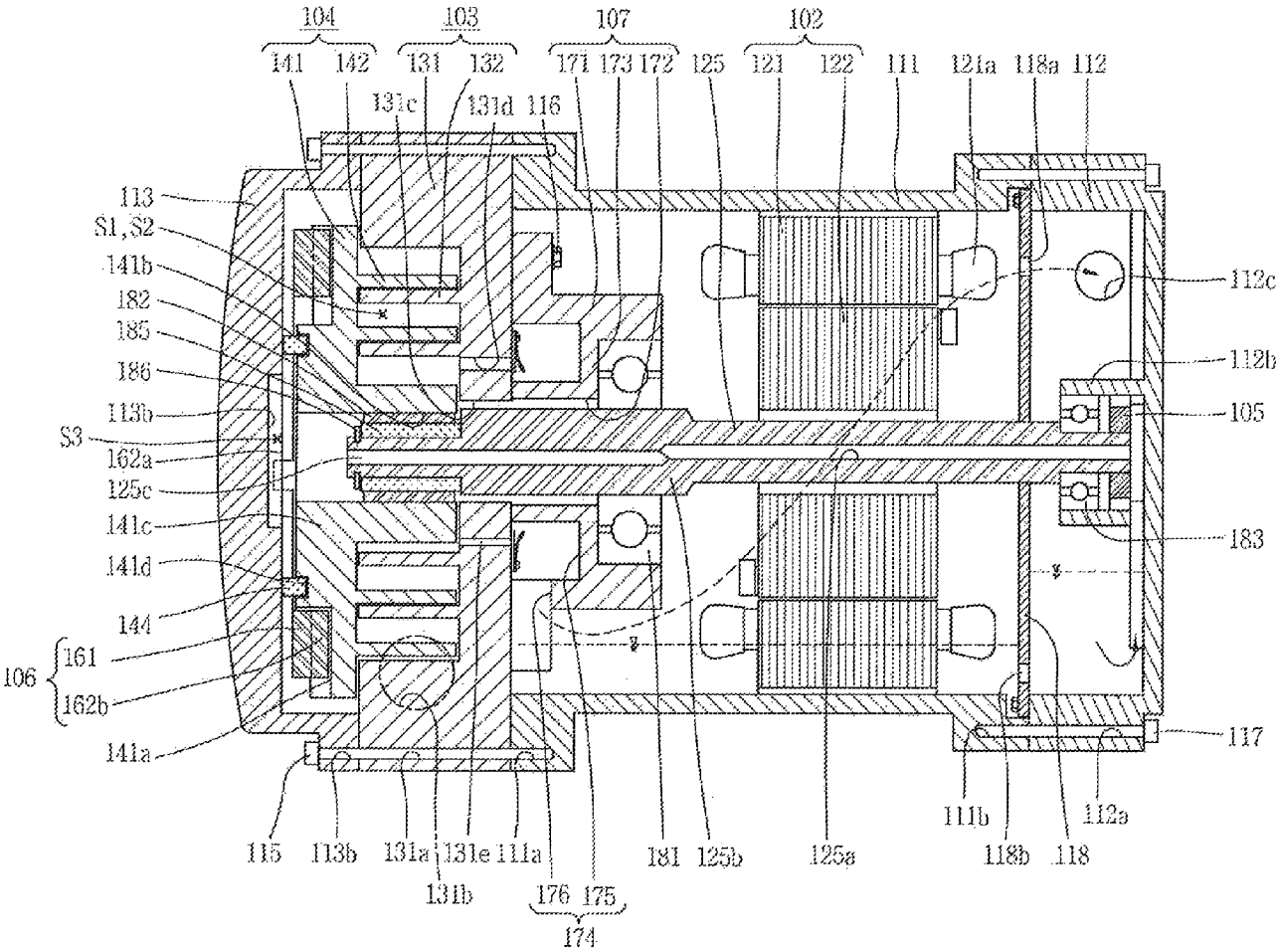
FIG. 4 is an assembled longitudinal sectional view of the horizontal type scroll compressor of FIG. 2.
Figure 5:
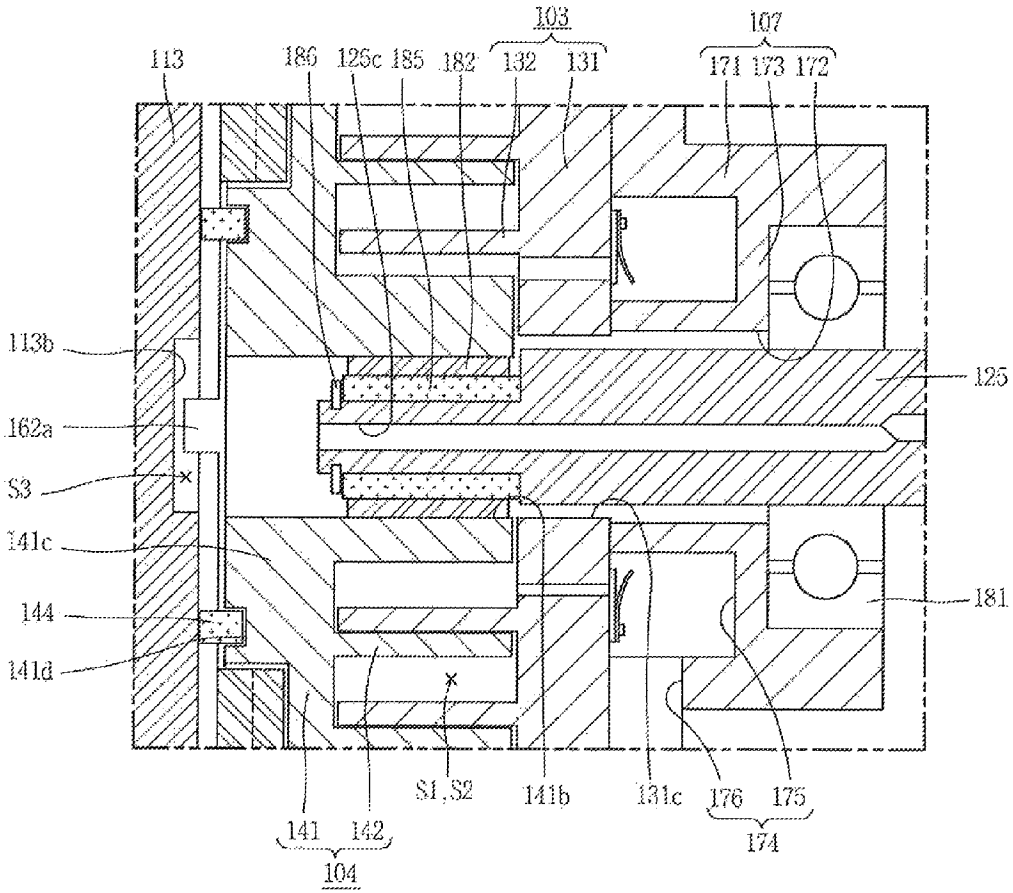
FIG. 5 is a longitudinal sectional view showing a compression part in the horizontal type scroll compressor of FIG. 4.

FIG. 2 is a perspective view showing one exemplary embodiment of a horizontal type scroll compressor in accordance with the present disclosure, FIG. 3 is a disassembled perspective view of the horizontal type scroll compressor of FIG. 2, FIG. 4 is an assembled longitudinal sectional view of the horizontal type scroll compressor of FIG. 2, and FIG. 5 is a longitudinal sectional view showing a compression part in the horizontal type scroll compressor of FIG. 4.

As shown in those drawings, a horizontal type scroll compressor according to the present disclosure may include a driving motor 102 installed within a casing 101 to generate a rotational force, a main scroll 103 coupled to one side (hereinafter, referred to as a front side) of the casing 101 to form a compression part as well as covering the casing 101, an orbiting scroll 104 coupled to a front side of the main scroll 103 to form the compression part together with the main scroll 103, and an oil pump 105 installed at another side (hereinafter, referred to as a rear side) of the driving motor 102 to supply oil stored within the casing 101 into the compression part.

The casing 101 may include a motor housing 111 having both ends open and the driving motor 102 installed therein, a pump housing 112 for covering the rear open end of the motor housing 111 and mounting the oil pump therein, and a front housing 113 coupled to the main scroll 103, which covers the front open end of the motor housing 111, so as to accommodate the orbiting scroll 104 therein.

Here, the main scroll 103 may be installed between the motor housing 111 and the front housing 113 to define a part of the casing 101. The front housing 113 may be coupled to the motor housing 113, with being spaced apart from the motor housing 111 by a thickness of a frame portion 131 of the main scroll 103, by use of coupling bolts 115, which are long enough to be inserted through the frame portion 131, which will be explained later.

The motor housing 111, the main scroll 103 and the front housing 113 may be coupled in an aligned state by using a plurality of reference pins 117, which are inserted through reference recess 111*c* formed on the motor housing 111 and reference recesses 113*c* formed on the front housing 113, and reference holes 131*f* formed on the main scroll 103 in a sequential manner.

The motor housing 111 may have a cylindrical shape, and its both open ends may be provided with coupling bores 111*a* and 111*b* for coupling of bolts. A terminal part 114 electrically connected to a coil 121*a* of the driving motor 102 may be formed at one side on an outer circumferential surface of the motor housing 111.

The driving motor 102 may include a stator 121 fixed to the motor housing 111 in a manner of shrink fitting or bolt coupling, and a rotor 122 rotatably coupled into the stator 121. The stator 121 may be wound by a coil 121*a*, and a crankshaft 125 for transferring the rotational force to the orbiting scroll 104 may be coupled into a center of the rotor 122.

An oil passage 125*a* may be extendedly formed in a central portion of the crankshaft 125 in a lengthwise direction of the crankshaft 125. An oil pump 105 may be installed at one end (e.g., a rear end) of the crankshaft 125 for supplying oil stored in the pumping housing 112 to another end (e.g., a front end) of the crankshaft 125. The oil pump 105 may be implemented as a positive displacement pump having a trochoid gear.

A diameter-extending portion 125*b* which is inserted into a main bearing 181 disposed in a bearing guide 107 to be explained later may be formed at a front end of the crankshaft 125. An eccentric pin 125*c* inserted into a shaft coupling portion 141*b* of the orbiting scroll 104 to be explained later may be formed at an end portion of the diameter-extending portion 125*b*. A bush 185 to be explained later may be coupled to the shaft coupling portion 141*b* and a pin bearing 182 for supporting the eccentric pin 125*c* may be coupled into the bush 185. The pin bearing 182 may appropriately be implemented as a needle bearing having a characteristic that its load bearing capacity is great as compared with its diameter. The eccentric pin 125*c* of the crankshaft 125 may be inserted into the pin bearing 182 implemented as the needle bearing to be supported in a radial direction.

The pump housing 112 may be formed in a shape of a cap whose front end is open. A coupling hole 112*a* which aligns with the rear coupling bore 111*b* of the motor housing 111 may be formed on the open end of the pump housing 112.

A bearing support portion 112*b* in which a sub bearing 183 for supporting the crankshaft 125 is installed may be formed in a central portion of the pump housing 112, and the oil pump 105 may be installed on the other side of the bearing support portion 112*b*.

An outlet 112*c* for guiding a refrigerant discharged from the compression part to be introduced into a refrigerating cycle may be formed at one side of the pump housing 112. A discharge pipe (not shown) may be connected to the outlet 112*c*.

The front casing 113 may be formed in a shape of a cap whose rear end is open, and through holes 113*a* may be formed through the open end of the front housing 113 to align with coupling holes 131*a* of the main scroll 103 to be explained later.

First key recesses 113*b* into which first keys 162*a* of an Oldham's ring 106 to be explained later are slidably coupled may be recessed into a front surface at an inner side of the front housing 113. The first key recesses 113*b* may be formed long in a radial direction with an interval of 180°

The main scroll 103 may include a frame portion 131 formed in a shape of plate, coupled to the front open end of the motor housing 111 and forming a fixed plate of the main scroll 103, and a fixed side wrap portion 132 formed at a front of the frame portion 131 and engaged with an orbiting wrap 142 of the orbiting scroll 104 to be explained later to form a first compression chamber S1 and a second compression chamber S2. The fixed side wrap portion 132 defines a fixed wrap. Hereinafter, it will thusly be briefly referred to as a fixed wrap.

The frame portion 131 may be formed in a shape of a plate having a predetermined thickness, and include coupling holes 131*a* formed on an edge thereof to align with the front coupling bore 111*a* of the motor housing 111 and the coupling holes 113*a* of the front housing 113, such that coupling bolts 115 are coupled all thereinto.

An inlet 131*b* may be formed on a side surface of the frame portion 131, and a suction pipe (not shown) may be connected to the inlet 131*b*.

A shaft hole 131*c* through which the front end of the crankshaft 125 is inserted may be formed in a central portion of the frame portion 131. A discharge port 131*d* may be formed adjacent to the shaft hole 131*c* such that a refrigerant compressed in the compression chambers S1 and S2 is discharged toward the motor housing 111. The discharge port 131*d* may also be formed out of a range of an outer diameter of a main bearing 181, which will be explained later, to prevent it from overlapping the main bearing 181. However, in this structure, a great dead volume may be generated in a central portion of a scroll. Therefore, the discharge port 131*d* may preferably be formed adjacent to the shaft hole 131*c* if possible. Bypass ports 131*e* for bypassing in advance a part of a refrigerant compressed in the compression chambers S1 and S2 may be formed adjacent to the discharge port 131*d*.

A bearing guide 107 for supporting the main bearing 181 may be coupled to a rear side surface of the frame portion 131 by use of bolts 116.

The bearing guide 107, as shown in FIG. 4, may include a guide body 171 formed in a cylindrical shape, a shaft receiving portion 172 formed through a middle of an inner circumferential surface of the guide body 171 and having a through hole for insertion of the crankshaft 125 therethrough. The guide body 171 may have one end bent to be coupled to the rear side surface of the main scroll 103 by use of the bolt 116. The guide body 171 may have an area large enough for a discharge guide portion 174, which will be explained later, to accommodate the discharge port 131*d* and the bypass ports 131*e* therein.

A bearing mounting portion 173 in which the main bearing 181 implemented as a ball bearing is inserted may be formed on one side surface of the shaft receiving portion 172. The discharge guide portion 174 for guiding a refrigerant discharged from the compression chambers toward the motor housing 111 may be formed at another side surface of the shaft receiving portion 172.

The bearing mounting portion 173 may be formed in a circular shape to have approximately the same inner diameter as an outer diameter of the main bearing 181.

The discharge guide portion 174 may include a first guide passage 175 corresponding to an annular space defined by the guide body 171, the shaft receiving portion 172 and a rear side surface of the main scroll 103, and accommodating the discharge port 131*d* and the bypass ports 131*e* therein, and a second guide passage 176 formed by opening an outer circumferential surface of the first guide passage 175 such that a refrigerant introduced into the first guide passage 175 is discharged toward the motor housing 111. The second guide passage 176 may be formed in plurality which are arranged along the outer circumferential surface of the first guide passage 175 with a predetermined interval.

In the meantime, the orbiting scroll 104 may include an orbiting plate 141 formed in a shape of plate to define a bearing surface together with the frame portion 131 of the main scroll 103, and an orbiting side wrap portion 142 formed on a rear side of the orbiting plate 141 and engaged with the fixed wrap 132. Here, the orbiting side wrap portion 142 may form an orbiting wrap. Therefore, the orbiting side wrap portion 142 may be briefly referred to as an orbiting wrap, hereinafter.

Second key recesses 141*a* which are long in a radial direction to allow second keys 162*b* of the Oldham's ring 160 to be slidably inserted may be recessed into a front surface of the orbiting plate 141. The second key recesses 141*a* may be formed with an interval of 180° and have approximately 90° phase difference from the first key recesses 113*b* of the front housing 113.

The shaft coupling portion 141*b* in which the eccentric pin 125*c* of the crankshaft 125 is inserted may be formed through the center of the orbiting plate 141. The bush 185 may be inserted into the shaft receiving portion 141*b*. The bush 185 may be undetachably fixed to the shaft coupling portion 141*b* by a bush fixing member, such as a snap ring 186, which is fixedly inserted into a fixing groove 125*d* formed on the eccentric pin 125*c*.

A pin bearing 182 in which the eccentric pin 125*c* of the crankshaft 125 is inserted may be coupled to the bush 185. The pin bearing 182 may be implemented as a needle bearing as aforementioned.

Figure 6:
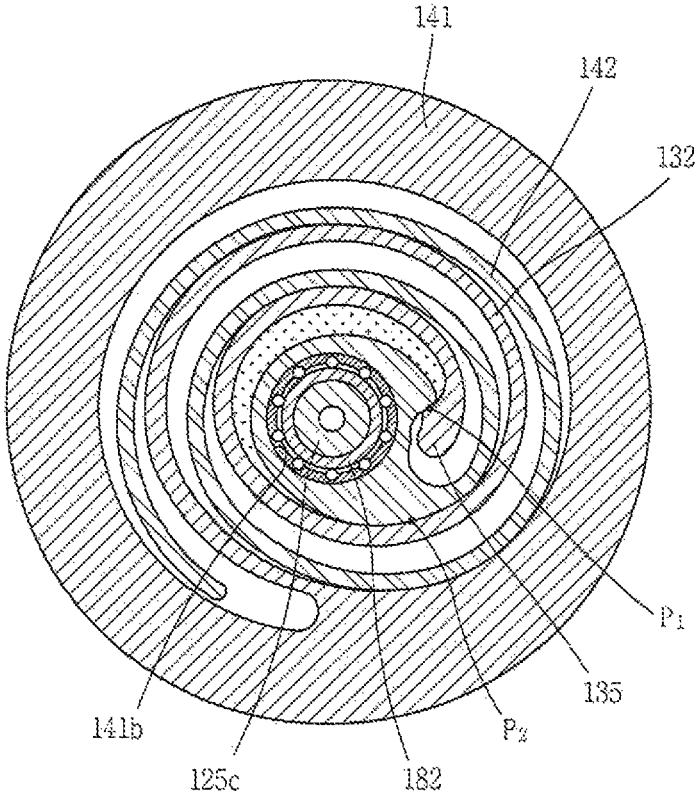
FIG. 6 is a horizontal sectional view showing one exemplary embodiment of a fixed wrap and an orbiting wrap defining the compression part in the horizontal type scroll compressor of FIG. 4.
Figure 7:
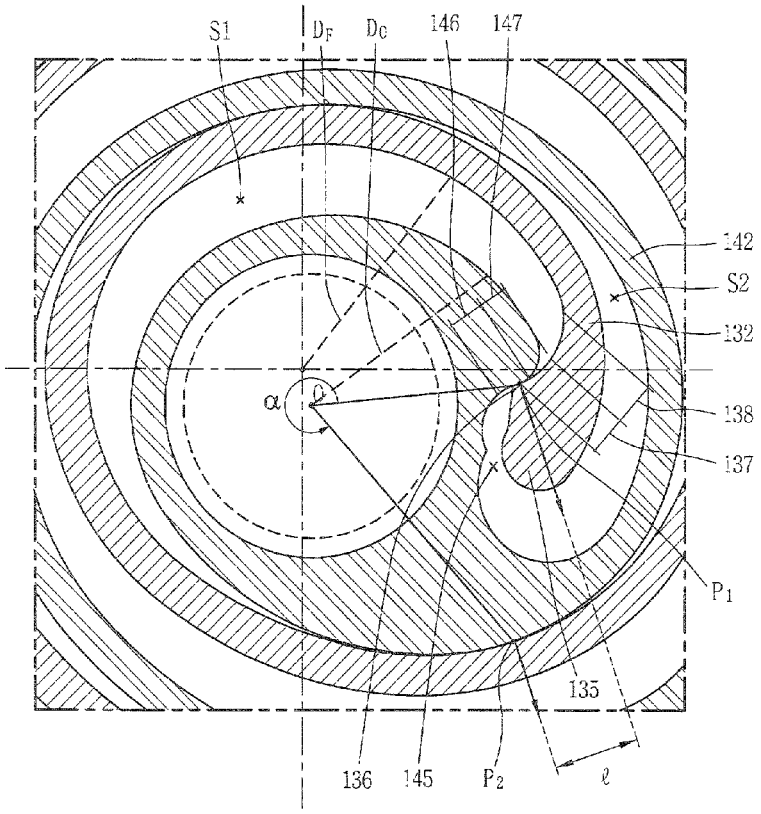
FIG. 7 is an enlarged horizontal sectional view showing surroundings of final compression chambers formed by the fixed wrap and the orbiting wrap of FIG. 6.

Meanwhile, the fixed wrap 132 and the orbiting wrap 142 may be formed in a shape of involute curve. Upon the use of the involute curve, wraps have a uniform thickness and accordingly a coefficient of volume change is constant. Therefore, in order to obtain a satisfactory compression ratio, the number of turns of the wrap has to increase. However, it also causes the compressor to increase in size. Therefore, according to this exemplary embodiment, as shown in FIGS. 6 and 7, when it is assumed that a compression chamber, which is formed between two contact points P1 and P2 generated as an inner surface of the fixed wrap 132 comes in contact with an outer surface of the orbiting wrap 142, is referred to as the first compression chamber S1, the first compression chamber S1 may be formed such that an angle defined by two lines which connect a center O of the eccentric pin 125*c* of the crankshaft 125 to the respective two contact points P1 and P2 is smaller than 360 and a distance 1 between normal vectors at each contact point P1 and P2 is greater than 0. Accordingly, the first compression chamber S1 just before discharging may have a smaller volume, as compared with having the fixed wrap and the orbiting wrap in the shape of the involute curve. This may result in an increase in a compression ratio. In addition, the fixed wrap 132 and the orbiting wrap 142 may have a shape formed by connecting a plurality of circular arcs having different diameters and start points from one another, and the outermost curve may have an approximately oval shape with a major axis and a minor axis.

A protrusion 135 may be formed adjacent to an inner end portion of the fixed wrap 132. The protrusion 135 may protrude toward the shaft coupling portion 141*b* of the orbiting scroll 104. A contact portion 136 may further protrude from the protrusion 135. That is, the inner end portion of the fixed wrap 132 may be formed to be thicker than the other portions in thickness. This may improve a wrap strength of the inner end portion which is affected by the greatest compression force of the fixed wrap 132, resulting in enhancement of durability.

As shown in FIG. 7, the thickness of the fixed wrap 132 may gradually decrease, starting from the inner contact point P1, which forms the first compression chamber S1 at the beginning of discharging, of the two contact points P1 and P2. In detail, a first decreasing portion 137 adjacent to the contact point P1 and a second decreasing portion 138 connected to the first decreasing portion 137 may be formed. A thickness decrease rate in the first decreasing portion 137 may be greater than that in the second decreasing portion 138. After the second decreasing portion 138, the fixed wrap 132 may continuously increase in thickness for a predetermined section.

A concave portion 145 which is engaged with the protrusion 135 may be formed at the shaft coupling portion 141*b* of the orbiting scroll 140. One side wall of the concave portion 145 may form one contact point of the first compression chamber S1 by contacting the contact portion 136 of the protrusion 135.

The one side wall of the concave portion 145 may include a first increasing portion 146 whose thickness relatively drastically increases, and a second increasing portion 147 connected to the first increasing portion 146 and having a thickness increasing at a relatively low ratio. They correspond to the first decreasing portion 137 and the second decreasing portion 138 of the fixed wrap 132. The first increasing portion, the first decreasing portion, the second increasing portion and the second decreasing portion may be obtained as a result of bending an envelope toward the shaft coupling portion 141*b*. Accordingly, the inner contact point P1 forming the first compression chamber S1 may be located at the first increasing portion 146 and the second increasing portion 147 and also a length of the first compression chamber S1 just before discharging may be shortened. This may result in improvement of a compression ratio.

Another side wall of the concave portion 145 may have a shape of arc. A diameter of the arc may be decided by a wrap thickness of the end portion of the fixed wrap 132 and an orbiting radius of the orbiting wrap 142. When the end portion of the fixed wrap 132 increases in thickness, the diameter of the arc may increase. The thickness of the orbiting wrap 142 near the arc may thusly increase so as to ensure durability. Also, a compression path may extend so as to increase a compression ratio of the second compression chamber S2.

Here, a central portion of the concave portion 145 may form a part of the second compression chamber S2. The second compression chamber S2 may contact the arcuate wall of the concave portion 145. When the crankshaft 125 rotates a little bit more, one end of the second compression chamber S2 may pass through the central portion of the concave portion 145.

Meanwhile, an Oldham's ring 106 as an anti-rotation member for guiding the orbiting scroll 104 to perform an orbiting motion may be installed between a front surface of the orbiting scroll 104 and a corresponding inner rear surface of the front housing 113.

The Oldham's ring 106, as shown in FIGS. 3 and 4, may include a ring portion 161 having an annular form, and first keys 162*a* and second keys 162*b* formed on front surface and rear surface of the ring portion 161, respectively. The first keys 162*a* may be formed with an interval of 180, similar to the first key recesses 113*b*. The second keys 162*b* may also be formed with the interval of 180° similar to the first keys 162*a*. The first key recesses 113*b* and the second key recesses 141*a* may be formed in a circumferential direction by an interval of 90° in an alternating manner.

In the meantime, a sealing member 144 for forming a back pressure chamber at the front of the orbiting scroll 104 may be disposed on the front surface of the orbiting scroll 104. To this end, a sealing protrusion 141*c* may be formed on a circumference of the shaft coupling portion 141*b* of the orbiting scroll 104, and a sealing recess 141*d* in which the sealing member 144 is inserted may be formed on the sealing protrusion 141*c*. Accordingly, a back pressure chamber S3 in a high pressure atmosphere due to oil (or discharged gas), which is introduced via the oil passage 125*a* of the crankshaft 125, may be formed inside the sealing member 144.

An unexplained reference numeral 118 denotes a pressure separate plate, 118*a* denotes a gas hole, and 118*b* denotes an oil hole.

Hereinafter, description will be given of an operation effect of the scroll compressor with the aforementioned configuration.

That is, when power is applied to the driving motor 102, the crankshaft 125 may rotate together with the rotor 122, to transfer a rotational force to the orbiting scroll 104.

The orbiting scroll 104 may accordingly orbit by an eccentric distance with respect to the main scroll 103, thereby forming the first compression chamber S1 and the second compression chamber S2, which continuously move, between the fixed wrap 132 and the orbiting wrap 142.

The first compression chamber S1 and the second compression chamber S2 may decrease in volume while moving toward the center by the continuously orbiting motion of the orbiting scroll 104. Accordingly, a refrigerant introduced into each of the compression chambers S1 and S2 via the inlet 131*b* may be compressed, and then discharged via the discharge port 131*d* communicating with the inner final compression chamber.

The refrigerant discharged via the discharge port 131*d* may flow into the inner space of the motor housing 111 via the discharge guide portion 174 of the bearing guide 107 and continuously flow into the pump housing 112 via the gas hole 118*a* of the pressure separate plate 118, thereby being introduced into a refrigerating cycle via the outlet 112*c*.

Simultaneously, the oil pump 105 which is located at the rear end of the crankshaft 125 may operate to pump up oil stored in the pump housing 112. The pumped oil may then be supplied into each bearing via the oil passage 125*a*.

The oil may partially be collected back into the motor housing 111 via each bearing. Some of oil which is discharged together with the refrigerant discharged from the compression chambers may be separated from the refrigerant by the bearing guide 107 and then collected back into the motor housing 111. The oil may then flow into the pump housing 112 via the oil hole 118*b* of the pressure separate plate 118 due to pressure difference, be pumped by the oil pump 105, and be supplied to each bearing, which series of operations may be repetitively executed.

As such, the main scroll forming the fixed scroll may be located between the motor housing and the front housing to be fixed to both of them. This may allow the fixed scroll to be installed without a separate frame, resulting in reduction of the number of components. In addition, the number of assembly parts may be reduced by coupling the motor housing, the main scroll and the front housing all together by use of long coupling bolts, reducing fabricating costs accordingly.

Also, the crankshaft may be inserted through the fixed wrap of the main scroll and the orbiting wrap of the orbiting scroll. This may allow an application point of a repulsive force of a refrigerant and an application point of a corresponding reaction point to be applied to the same portion, thereby preventing the orbiting scroll from being inclined. With forming the protrusion and the concave portion at the discharge side of the fixed wrap and the orbiting wrap, a compression ratio of a first compression chamber may be improved more than a scroll compressor having a fixed wrap and an orbiting wrap with an involute shape. Therefore, a thickness of an inner end portion of the fixed wrap may increase, which may result in improvement of a wrap strength and a leakage-preventing function.

Hereinafter, description will be given of the horizontal type scroll compressor having a plurality of pins as an anti-rotation member.

That is, the foregoing exemplary embodiment illustrates that the Oldham's ring having keys is applied as the anti-rotation member. However, for the Oldham's ring having the keys, keys and key recesses have to be formed on the Oldham's ring and the front housing and the orbiting scroll, which align with the Oldham's ring. This may cause difficulty in processing and increase fabricating costs. Further, a load of a motor may increase due to the heavy weight of the Oldham's ring and oil should be sufficiently supplied due to a wide frictional area of the Oldham's ring.

Figure 8:
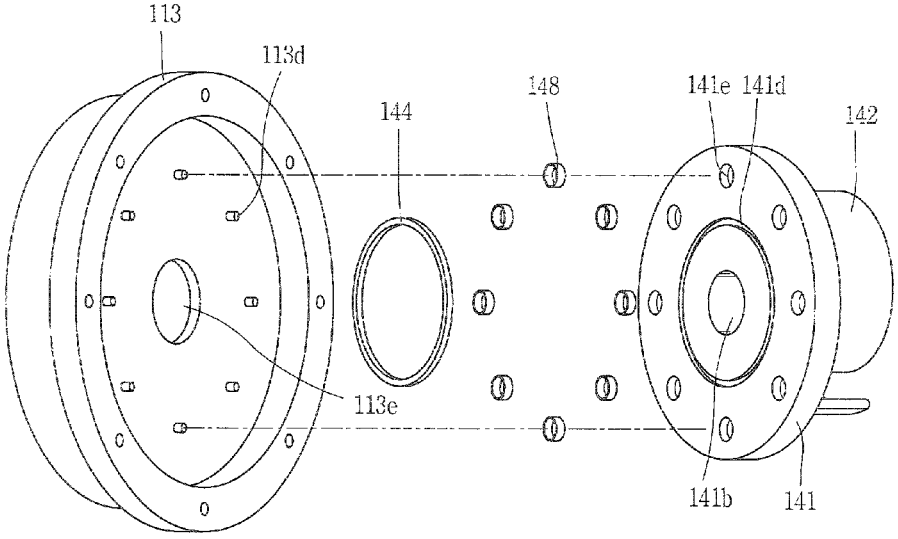
FIGS. 8 and 9 are a disassembled perspective view and an assembled sectional view, respectively, showing another exemplary embodiment of an anti-rotation member in the horizontal type scroll compressor of FIG. 3.
Figure 9:
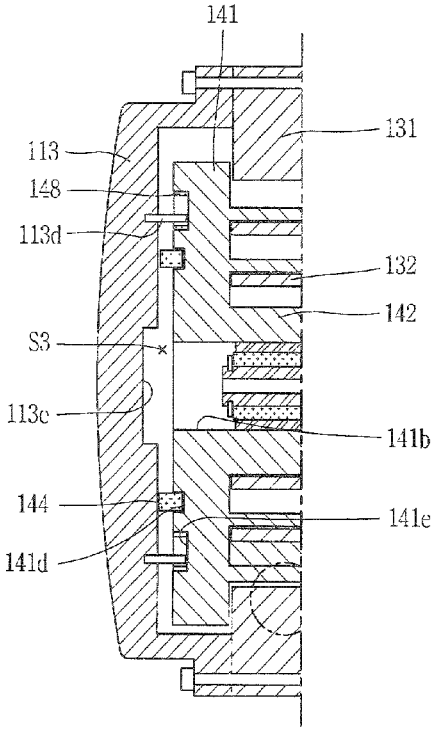

Considering such drawbacks, as shown in FIGS. 8 and 9, pin recesses 141*e* may be recessed into the front surface of the orbiting plate 141, and pin members 113*d*, which is orbitingly inserted into the pin recesses 141*e* to prevent rotation of the orbiting scroll 104, may be coupled to the front housing 113. The pin recesses 141*e* may be formed as many as the pin members 113*d*. Each of the pin recesses 141*e* may have an inner diameter enough for the pin member 113*d* to orbit smoothly therein. Accordingly, although the rotational force is transferred from the driving motor to the orbiting scroll, the pin members 113*d* may be inserted into the pin recesses 141*e* such that the pin recesses 141*e* can be restricted by the pin members 113*d*. This may allow the orbiting scroll to perform an orbiting motion without rotation.

Ring members 148 may be press-fitted to an inner circumferential surface of the pin recesses 141*e*, respectively, to prevent the abrasion of the pin recesses 141*e* due to friction against the pin members 113*d*. The ring member 148 may be made of a material whose strength is not smaller than that of the pin member 113*d*. The ring member 148 may also preferably be formed of a material having high abrasion resistance or a self-lubricating material to enhance a lubricative property with the pin member 113*d* without a separate oil supply.

Here, the pin recesses may be formed on the front housing and the pin members may be formed on the orbiting scroll. However, considering that the ring members be taken off while assembling the ring members to the pin recesses, the pin recesses may more preferably be formed on the front surface of the orbiting scroll. An unexplained reference numeral 113*e* denotes a groove forming a back pressure chamber.

As such the anti-rotation member implemented by the pin members and the pin recesses is disposed between the orbiting scroll and the front housing, the structure of the anti-rotation member may be simplified and the structures of the orbiting scroll and the front housing may also be simplified. This may facilitate for the fabrication of the orbiting scroll and the front housing as well as the anti-rotation member, resulting in reduction of fabricating costs of the orbiting scroll and the front housing contacting the anti-rotation member as well as the anti-rotation member.

Also, a load of a motor may be reduced by minimizing the weight of the anti-rotation member, and a frictional area may be minimized due to a linear contact between the pin member and the pin recess. Consequently, although a less amount of oil is supplied or oil is not temporarily supplied, the rotation of the orbiting scroll may effectively be prevented, enhancing design flexibility of the compressor.

In the meantime, the anti-rotation member may be implemented as an Oldham s ring (hereinafter, referred to as a ring member) which is made by removing keys from the general Oldham's ring.

Figure 10:
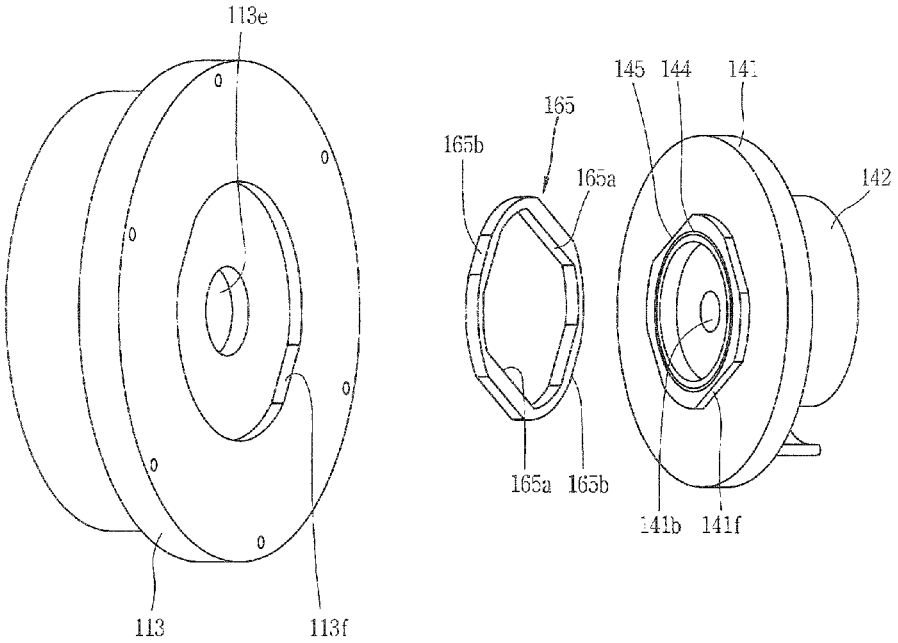
FIGS. 10 and 11 are a disassembled perspective view and an assembled sectional view, respectively, showing another exemplary embodiment of an anti-rotation member in the horizontal type scroll compressor of FIG. 3.
Figure 11:
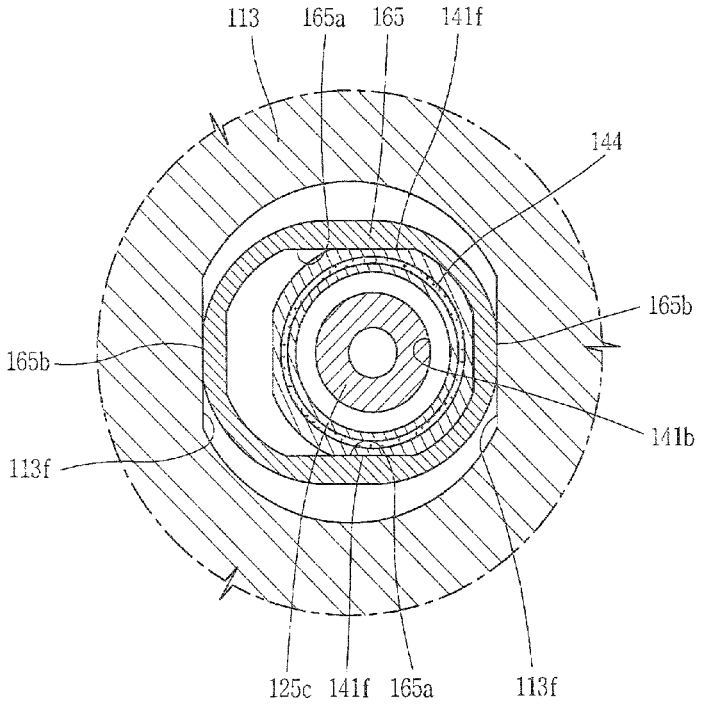

For example, as shown in FIGS. 10 and 11, a first guide surface 141*f* and a second guide surface 113*f* may be orthogonally formed on the front surface of the orbiting scroll 104 and the rear surface of the front housing 113, respectively. A first sliding surface 165*a* and a second sliding surface 165*b* may be formed on the inner circumferential surface and the outer circumferential surface of the ring member 165, respectively, to be slidably contactable with the first guide surface 141*f* and a second guide surface 113*f*.

The first guide surface 141*f* and the second guide surface 113*f* may be provided in plurality, respectively, to be orthogonal to each other. The first sliding surface 165*a* and the second sliding surface 165*d* may be provided in plurality, respectively, to be orthogonal to each other.

Although the orbiting scroll 104 receives the rotational force from the driving motor 102, the first sliding surfaces 165*a* and the second sliding surfaces 165*b* of the ring member 165 and the first guide surfaces 141*f* and the second guide surfaces 113*f* may contact each other and be restricted by each other in a perpendicular direction. Therefore, the orbiting scroll 104 may perform the orbiting motion without rotation.

Even in this structure, the simplified structure of the anti-rotation member may facilitate for the fabrication thereof, which may result in reduction of fabricating costs of the orbiting scroll and the front housing contacting the anti-rotation member as well as the anti-rotation member. Also, a load of a motor may be reduced by virtue of reduction of the weight of the anti-rotation member.

The invention claimed is:

1. A horizontal type scroll compressor comprising:

a motor housing having an inner space for installation of a driving motor therein;

a main scroll coupled to one side of the motor housing to seal the inner space of the motor housing, and having a fixed wrap to form compression chambers;

an orbiting scroll having an orbiting wrap engaged with the fixed wrap of the main scroll and coupled to a crankshaft inserted through the main scroll, wherein the orbiting scroll forms a first compression chamber and a second compression chamber on an outer surface and an inner surface of the orbiting wrap while performing an orbiting motion; and a front housing hermetically coupled to the main scroll, wherein the front housing accommodates the orbiting scroll, wherein a plurality of coupling bores is formed on the motor housing in a circumferential direction, and a plurality of through holes aligning with the plurality of coupling bores of the motor housing is formed through the main scroll and the front housing, respectively, and wherein the main scroll and the front housing are coupled to the motor housing using bolts inserted into the plurality of coupling bores through the plurality of through holes.

2. The compressor of claim 1, wherein an inlet is formed on an outer circumferential surface of the main scroll, and a discharge port is formed on one side surface of the main scroll facing the inner space of the motor housing.

3. The compressor of claim 2, wherein a bearing that supports the crankshaft is provided on one side surface of the main scroll, and wherein the bearing is installed on a bearing guide coupled to the main scroll.

4. The compressor of claim 1, wherein each of the motor housing, the main scroll, and the front housing is provided with at least one reference recess and at least one reference hole in an aligning manner such that at least one reference pin is inserted into the at least one reference recess and the at least one reference hole.

5. A horizontal type scroll compressor comprising:

a casing having a motor housing and a front housing;

a driving motor installed within an inner space of the motor housing and having a rotor;

a crankshaft coupled to the rotor;

a main scroll having a fixed wrap, and provided between the motor housing and the front housing; and an orbiting scroll having an orbiting wrap engaged with the fixed wrap of the main scroll and coupled to a crankshaft inserted through the main scroll, wherein the orbiting scroll forms a first compression chamber and a second compression chamber on an outer surface and an inner surface of the orbiting wrap while performing an orbiting motion, wherein a shaft coupling portion to which the crankshaft is inserted is formed through the orbiting scroll, wherein the orbiting scroll is accommodated within the front housing wherein a plurality of coupling bores is formed on the motor housing in a circumferential direction, and a plurality of through holes aligning with the plurality of coupling bores of the motor housing is formed through the main scroll and the front housing, respectively, and wherein the main scroll and the front housing are coupled to the motor housing using bolts inserted into the plurality of coupling bores through the plurality of through holes.

6. The compressor of claim 5, further including a bearing formed on an inner circumferential surface of the shaft coupling portion to support the crankshaft.

7. The compressor of claim 5, wherein an eccentric pin is formed on a front end of the crankshaft, and a bush is inserted into the eccentric pin so as to be inserted into the bearing provided on the shaft coupling portion, and wherein a snap ring that supports the bush in an axial direction is coupled to the eccentric pin.

8. The compressor of claim 5, wherein the casing includes a front housing hermetically coupled to the main scroll that accommodates the orbiting scroll therein, and wherein a sealing member is installed between the orbiting scroll and the front housing such that a back pressure chamber is formed around the shaft coupling portion that accommodates the shaft coupling portion therein.

9. The compressor of claim 8, wherein an oil passage is formed through the crankshaft in an axial direction, and the oil passage communicates with the back pressure chamber.

10. The compressor of claim 5, wherein the motor housing is hermetically coupled to one side surface of the main scroll, the motor housing having the driving motor installed therein, wherein a pump housing is coupled to another end of the motor housing to seal an inner space of the motor housing, wherein the pump housing accommodates an oil pump provided at an end portion of the crankshaft, and wherein a pressure separate plate having a gas hole and an oil hole is installed between the motor housing and the pump housing.

11. The compressor of claim 1, wherein a plurality of pin members is provided on one of a rear surface of the orbiting scroll or a casing, and a plurality of pin recesses is formed on the other one, and wherein the plurality of pin members is inserted into the plurality of pin recesses to allow for orbiting of the orbiting scroll.

12. The compressor of claim 11, wherein a ring member is inserted into each of the plurality of pin recesses, the ring member being formed of a material having a higher abrasion resistance than an abrasion resistance of the pin member.

13. The compressor of claim 1, wherein a ring member is provided between a rear surface of the orbiting scroll and a casing, the ring member preventing rotation of the orbiting scroll, and wherein an inner circumferential sliding surface and an outer circumferential sliding surface are perpendicularly formed on an inner circumferential surface and an outer circumferential surface of the ring member, respectively, the sliding surfaces slidably contacting guide surfaces, respectively, in a radial direction, the guide surfaces being provided on the casing and the orbiting scroll, respectively.

14. The compressor of claim 5, wherein the first compression chamber is formed between two contact points generated as an inner surface of the fixed wrap and an outer surface of the orbiting wrap contact each other, wherein the crankshaft includes an eccentric pin coupled to a shaft coupling portion of the orbiting scroll, and wherein $\alpha<360°$ at least before a beginning of discharging when $\alpha$ is a larger angle of angles formed by two lines connecting a center of the eccentric pin of the crankshaft and the two contact points, respectively.

15. The compressor of claim 5, wherein each of the motor housing, the main scroll, and the front housing is provided with at least one reference recess and at least one reference hole in an aligning manner such that the at least one reference pin is inserted into the at least one reference recess and the at least one reference hole.

* * * * *